US005959604A

United States Patent [19]

Mosier

[11] Patent Number: 5,959,604

[45] Date of Patent: Sep. 28, 1999

[54] METHOD AND APPARATUS FOR MONITORING LCD DRIVER PERFORMANCE

[75] Inventor: Donald E. Mosier, Cedar Rapids, Iowa

[73] Assignee: Rockwell International Corporation, Costa Mesa, Calif.

[21] Appl. No.: 08/721,070

[22] Filed: Sep. 26, 1996

[51] Int. Cl.[6] ..... G09G 3/36

[52] U.S. Cl. ..... 345/100; 345/98

[58] Field of Search ..... 345/98, 99, 100, 345/87, 88, 89, 90, 91, 92, 93, 94, 101, 102, 147, 148, 149, 204, 207, 211, 214

[56] References Cited

U.S. PATENT DOCUMENTS

| | | | |
|---|---|---|---|
| 4,760,389 | 7/1988 | Aoki et al. | 345/92 |
| 4,845,482 | 7/1989 | Howard et al. | 345/92 |
| 5,089,812 | 2/1992 | Fuse et al. | 345/147 |
| 5,302,946 | 4/1994 | Shapiro et al. | 345/88 |
| 5,369,432 | 11/1994 | Kennedy | 345/88 |
| 5,459,483 | 10/1995 | Edwards | 345/98 |

*Primary Examiner*—Xiao Wu

*Attorney, Agent, or Firm*—Kyle Eppele; James P. O'Shaughnessy

[57] ABSTRACT

A method and apparatus for monitoring the performance of a liquid-crystal display driver is described. The monitoring apparatus includes an analog feedback stage comprising an array of analog switches including a single switch for each output of the display driver wherein the output of each switch is connected to a single feedback line. A control circuit selectably actuates any of the switches such that the corresponding display driver output line is connected to the feedback line. The signal at any selected display driver output line may be monitored to ensure proper functioning thereof. The performance of the display drivers and supporting circuitry may be thereby monitored.

14 Claims, 2 Drawing Sheets

METHOD AND APPARATUS FOR MONITORING LCD DRIVER PERFORMANCE

BACKGROUND OF THE INVENTION

The present invention generally relates to the field of liquid-crystal displays (LCDs), and more particularly to a method and apparatus for monitoring LCD driver performance.

There are many applications in which it is desirable to be able to monitor the performance of the driver circuitry of a liquid-crystal display to ensure high integrity performance of the display. For example, in an avionics environment, a liquid-crystal display may be utilized as a primary flight display (PFD) where information vital to the operation of the craft is displayed. The analog nature and the complexity of the display drivers for liquid-crystal displays renders accurate monitoring of the operation of the display drivers difficult. Precise monitoring of the performance of the display drivers is therefore critical to ensuring the liquid-crystal display panel is properly functioning.

Previous implementations of LCD driver monitoring circuits typically provided a simple digital feedback signal merely indicating whether the input shift register of the display driver was operational. However, the only useful information provided by such a display driver monitoring system was whether or not the driver had suffered a catastrophic failure which would have been readily apparent to the user in any event in that the display would be inoperative. No LCD driver monitoring system known to date provides an analog monitoring system which monitors the actual analog output voltage for individual display driver output pins.

SUMMARY OF THE INVENTION

Accordingly, it is a goal of this invention to provide a method and apparatus for monitoring the performance of a liquid-crystal display.

Another goal is to provide a method and apparatus for monitoring the performance of the display drivers in a liquid-crystal display.

It is an object of the present invention to be able to selectively monitor the analog output voltage of each of the driver output pins of a liquid-crystal display driver.

It is a further object of the present invention to provide high integrity assurance that the display drivers in a liquid-crystal display panel are properly functioning.

It is yet another goal of the present invention to be able to readily test all of the driver output lines of an LCD display driver utilizing a test fixture having fewer input pins than the number of display driver output lines.

It is still a further goal of the present invention to provide high integrity assurance that the analog circuitry associated with the LCD drivers and the digital graphics circuitry driving the LCD display are functioning properly.

These and other goals may be achieved by selectively connecting a monitoring switch operatively connected to a driver output of the display driver to a feedback line for directly monitoring the analog voltage of the driver output.

It is to be understood that both the foregoing general description and the following detailed description are exemplary and explanatory only and are not restrictive of the invention as claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DESCRIPTION OF THE PREFERRED EMBODIMENT

Reference will now be made in detail to the presently preferred embodiment of the invention, an example of which is illustrated in the accompanying drawings.

Figure 1:
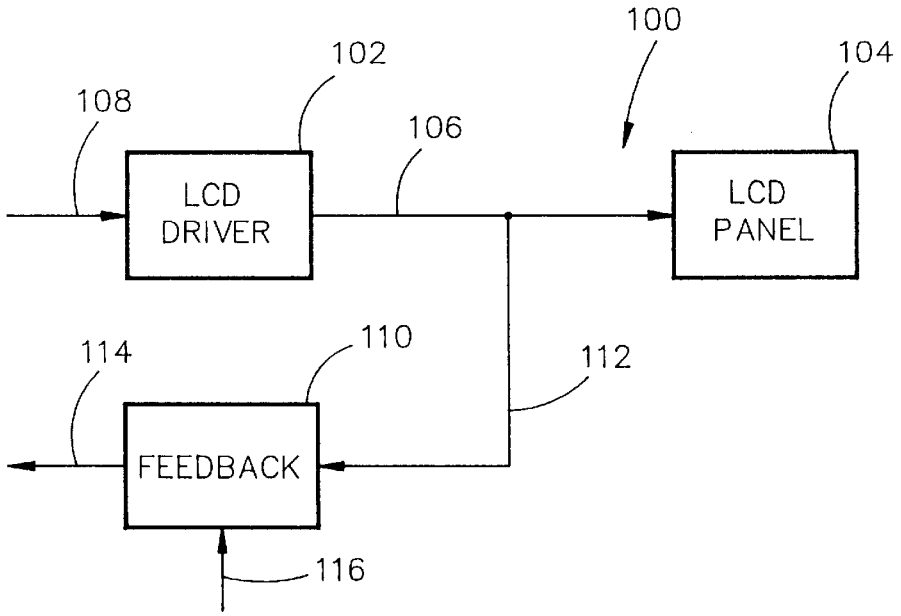
FIG. 1 is a conceptual schematic diagram illustrating the apparatus for monitoring the performance of a liquid-crystal display driver in accordance with the present invention.

Referring now to FIG. 1, a conceptual diagram of the apparatus for monitoring the performance of a liquid-crystal display is shown. The monitoring system 100 comprises a liquid-crystal display driver ("LCD DRIVER") 102 operatively connected to a liquid-crystal display panel ("LCD PANEL") 104. The LCD driver 102 supplies the necessary driving and control signals to the LCD panel 104 via a driver output line 106. The LCD driver 102 drives the LCD panel 104 based upon display data received via data input line 108. The LCD panel 104 may be an active matrix LCD wherein the voltage applied to each display element is controlled independently. Thus, monitoring of the output line 106 of the LCD driver is critical to maintaining the operational integrity of the LCD panel 104.

Each display element of an active matrix display utilizes a thin-film transistor (TFT) to control the voltage applied the display element. The TFT is utilized to maintain a voltage across the liquid-crystal at each selected display element for the entire duration of a refresh cycle. The signal produced by LCD driver 102 at the driver output line 106 which drives the TFTs of the LCD is an analog signal and therefore requires an analog means for monitoring the performance of the LCD driver 102. Precise monitoring of the driver output line 106 may be accomplished through an analog feedback stage 110 which provides a means for monitoring the analog voltage signal produced at the driver output 106 of the LCD driver 102. The output signal of the LCD driver may be tapped off of the driver output line 106 via feedback line 112. The feedback stage 110 provides a single feedback line output 114 which thereby provides a means for monitoring the performance of the LCD driver 102 using only a single line. The feedback line output 114 may be monitored by a monitoring circuit, processor or controller, for example, or may be connected to testing circuitry during the manufacturing process, etc. The feedback stage 110 may be selectably actuated via a feedback control input 116.

Figure 2:
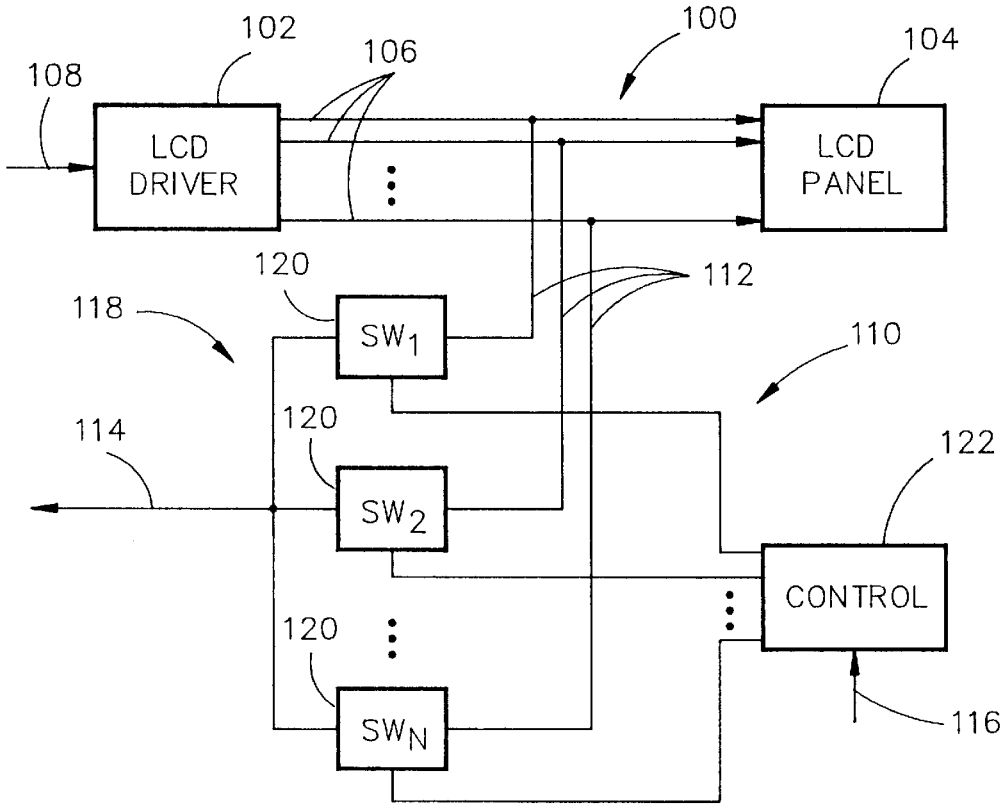
FIG. 2 is a conceptual schematic diagram further illustrating the apparatus for monitoring the performance of a liquid-crystal display driver in accordance with the present invention.

Referring now to FIG. 2, the apparatus for monitoring the performance of a liquid-crystal display driver of FIG. 1 is shown wherein the feedback stage is depicted in further detail. The LCD driver panel 102 provides N number of driver output lines to the LCD panel 104. The LCD panel 104 utilized with the present invention may be capable of displaying gray scale images, for example, in which the amount of light transmitted through the LCD panel 104 is a function of the voltage applied across the liquid-crystal material. By varying the magnitude of the voltage applied to a display element by the LCD driver 102, the display element may transmit light at varying transmittance levels to produce an image varying from white to black or shades of gray therebetween. Thus, the driver output signal 106 of the LCD driver is an analog signal continuously varying between maximum and minimum values. The voltage of the driver output 106 must be carefully monitored to determine if the magnitude of the applied signal is the correct value, which is typically difficult to monitor using digital techniques.

The feedback stage 110 shown in FIG. 2 provides precise monitoring of the analog voltage levels at each of the N LCD driver output lines 106. The feedback stage 110 comprises an array of switches 118 comprising N switches 120 wherein each switch 120 is connected to a corresponding respective driver output line 106 as an input thereto. The output of each switch 120 is connected to a single feedback line 114. The switches 120 are controlled by a control circuit 122 which operates to selectably actuate each of the switches 120. The control circuit 122 receives a feedback control input 116 through which the control circuit may selectably control the actuation of a specific switch to select corresponding respective output lines 106. In such an arrangement, any one of the individual driver output lines 106 may be selectably connected to the feedback line 114. The signal at the feedback line 114 may be proportional to the voltage at a given driver output 106, may be equal to or substantially equal to the voltage at a given driver output 106, or may be the actual voltage signal at the driver output 106. The exact analog voltage at each of the driver outputs 106 may be thereby monitored to determine proper functionality. For example, if the magnitude of the voltage at a given driver output line 106 does not match the expected value required to produce the desired transmittance indicated by the display input data 108, then a malfunctioning driver condition may thereby be detected. Various other parameters of the LCD driver 102 and the LCD panel 104 may be monitored with the apparatus of FIG. 2 as well. For example, a constant low voltage output at a particular driver output line 106 regardless of the indicated input level may indicate a short circuit condition.

One particular application of the LCD driver performance monitoring apparatus 100 of the present invention may be in the manufacturing of the LCD driver circuits. Typically, the test fixtures (not shown) that are utilized to test the LCD driver 102 do not have a sufficient number of input pins to receive all of the driver output lines 106, particularly for divers having a very large number of output singals. However, by utilization of the present invention, the text fixture need only require a sufficient number of pins to receive at least the single feedback line 114. Thus, a single input pin of the test fixture may be able to test N driver output lines 106 for a given LCD driver circuit 102, thereby simplifying the test fixture apparatus.

Figure 3:
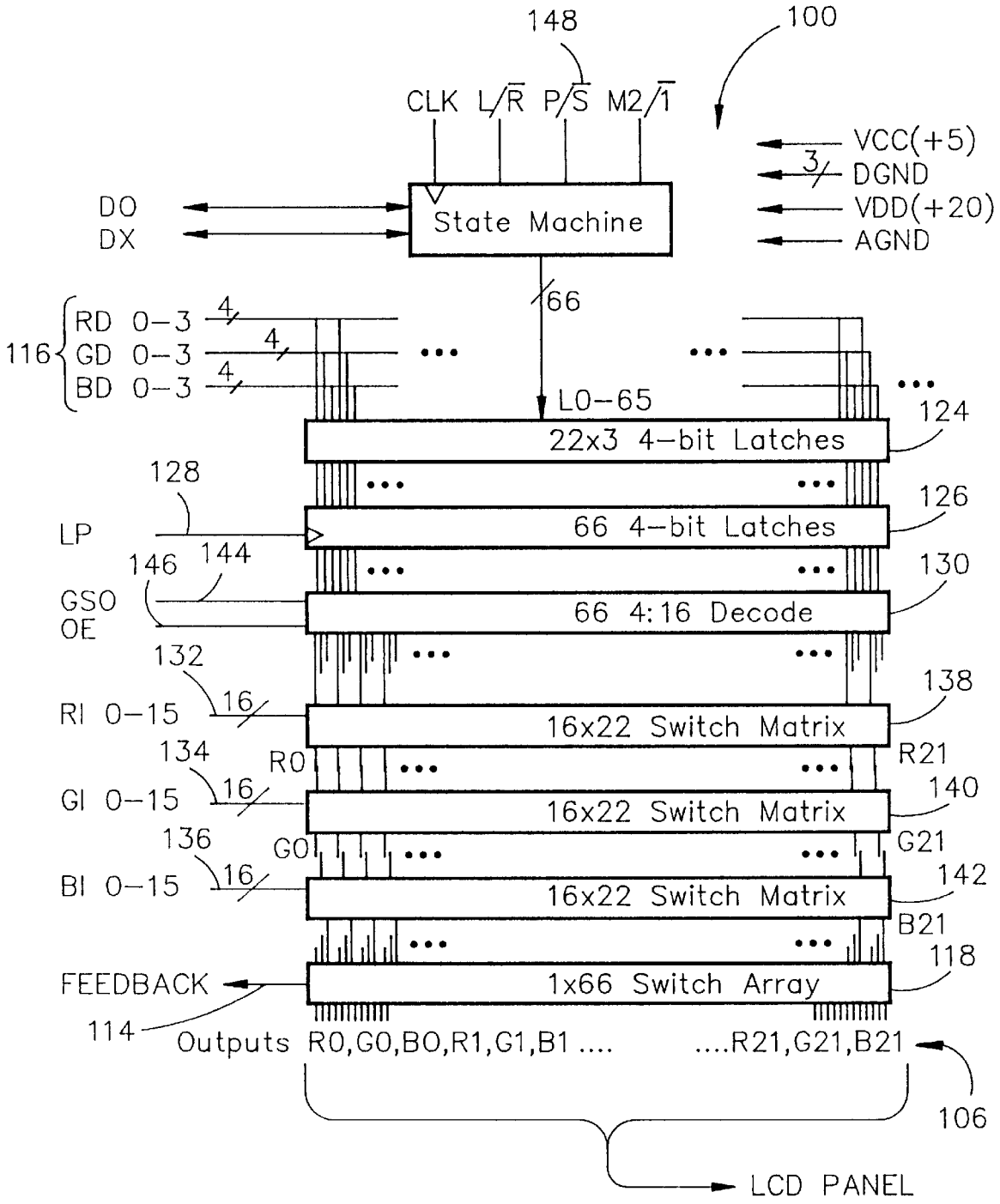
FIG. 3 is a schematic diagram illustrating the apparatus for monitoring the performance of a liquid-crystal display driver in accordance with the present invention.

Referring now to FIG. 3, a preferred LCD column driver arrangement incorporating the method and apparatus for monitoring LCD driver performance of the present invention is shown. As shown in FIG. 3, the driver accepts input data which is stored in a first set of 66 4-bit latches 124. After an entire group of data is collected, it is transferred to a second set of latches 126, as controlled by the LP input control signal 128. Each of these 4-bit values is the demuxed with a 4:16 decoder 130 into 16 control lines for selecting one of 16 analog input voltages (132, 134 and 136), with each set reserved for controlling either red, green, or blue display elements controlled by corresponding switch matrices (138, 140 and 142). The outputs of the decoder 130 are interleaved such that every third output uses the red voltages 132, with the green and blue voltages (134 and 136) used in turn. The 4:16 decoder 130 also has provisions for forcing all outputs to either the zero state or an open state upon receipt of the GSO and OE signals, (144 and 146) respectively. All switches in the matrices (138, 140 and 142) must be driven to an open state during the LP data transition to ensure that internal shorting between gray scale voltages is never present. Internal circuitry must be included to perform this "break-before-make " function without the use of the external OE signal 146.

Data may be loaded into the first latch register group 124 in several different ways, depending on the requirements of the external controller (not shown). The configuration depicted in FIG. 3 has been chosen specifically to be as flexible as possible, being adaptable to a large number of different controller types.

When the P/S signal is high, the red, green and blue data values are read in parallel, with three 4-bit values loaded at every clock pulse. Either 22 or 21 data sets are loaded, depending on the state of the M2/1 control lines. If this signal is high, all 22 sets of data are loaded, with the carry out signal being activate at the $23^{rd}$ input. If M2/1 is low, only 21 sets of data are loaded, with the carry out active at the $22^{nd}$ input. In this case, outputs R21, G21 and B21 are not used. The switch between 22 and 21 data pairs is included to allow three drivers in combination to drive 192 column lines with properly coordinated carry out signals.

If the P/S control line is low, then a single 4-bit data value is loaded for each clock pulse. A total of 64 values are loaded when M2/1 is low, with the carry out signal being active at the $65^{th}$ input such that the $65^{th}$ data value would be loaded into a cascaded driver. Outputs G21 and B21 are not used. When M2/1 is high, all 66 values are loaded and all outputs are used. When used in either of these modes, the three sets of data inputs may be externally connected in parallel to reduce the external circuitry requirements. However, all the internal data paths are maintained.

The L/R lines are used to determine the sequence in which data is loaded. When L/R is low, the data is loaded starting with L0 and proceeding with successively higher numbers. D0 is the input signal which initiates loading, with DX being the carry out signal. When L/R is high, DX is the initiating input, D0 is the carry out, and the data loading starts at the appropriate higher value and proceeds to zero.

An additional switch array 118 is used to allow the external monitoring of any one of the 66 output drive lines 106 in accordance with the present invention. When the LP line 128 is high, the 7-bit value present on the RD 0–2 and GD 0–3 input data lines (RD2=MSB, GD0=LSB) at the falling edge of the clock CLK is loaded into a feedback control register. This value is then used to select a single output drive line 106 which is thereby connected to the feedback line 114. Thus, selective control of the switch array 118 may be based upon the RD, GD and GD data lines 116 and the state of the LP line 128. The feedback switch array 118 may be physically located adjacent to the die outputs on which the LCD driver 100 is fabricated to maximize monitoring coverage. "Break-before-make" provisions must also be provided for this switch array 118 also to prevent internal shorting between gray scale voltages.

It is believed that the method and apparatus for monitoring LCD driver performance of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An apparatus for monitoring the performance of a display driver of a liquid-crystal display, the apparatus comprising:

(a) a liquid-crystal display driver having two or more driver outputs, each of the two or more driver outputs providing an analog driver output signal to the liquid-crystal display in response to a data input signal; and (b) a selectably actuatable feedback circuit operatively receiving the analog driver output signal for providing a feedback signal via a feedback line to a monitoring device wherein any one of the two or more driver outputs may be selectively coupled to a single input of the monitoring device such that the monitoring device is capable of monitoring the selectively coupled driver output.

2. The apparatus for monitoring the performance of a display driver of a liquid-crystal display of claim 1 wherein said selectably actuatable feedback circuit comprises a switch connected between the two or more driver outputs of said liquid-crystal display driver and the feedback line, said selectably actuatable feedback circuit operatively controlling the operation of said switch such that the analog driver output signal is provided to the monitoring device via the feedback line.

3. The apparatus for monitoring the performance of a display driver of a liquid-crystal display of claim 1 wherein the feedback signal provided by the selectably actuatable feedback circuit is proportional to the analog driver output signal produced by said liquid crystal display driver.

4. The apparatus for monitoring the performance of a display driver of a liquid-crystal display of claim 1 wherein the feedback signal provided by the selectably actuatable feedback circuit is substantially equal to the analog driver output signal produced by said liquid crystal display driver.

5. The apparatus for monitoring the performance of a display driver of a liquid-crystal display of claim 1 wherein the feedback signal provided by the selectably actuatable feedback circuit is equal to the analog driver output signal produced by said liquid crystal display driver.

6. The apparatus for monitoring the performance of a display driver of a liquid-crystal display of claim 1 wherein the feedback signal provided by the selectably actuatable feedback circuit is the analog driver output signal produced by said liquid crystal display driver.

7. An apparatus for monitoring the performance of a display driver of a liquid-crystal display, the apparatus comprising:

(a) a liquid-crystal display driver having a plurality of driver outputs, each of the driver outputs producing an analog driver output signal to the liquid-crystal display in response to a data input signal;

(b) a selectably actuatable feedback circuit operatively receiving the analog driver output signals for providing a feedback signal via a feedback line to a monitoring device; and (c) means for controlling the selectable actuation of said feedback circuit wherein each driver output of the plurality of driver outputs may be individually received by said selectably actuatable feedback circuit.

8. The apparatus for monitoring the performance of a display driver of a liquid-crystal display of claim 7 wherein said selectably actuatable feedback circuit comprises an array of switches such that each switch of said array of switches is connected between a corresponding respective driver output of said liquid-crystal display driver and the feedback line, said control means operatively controlling the operation of each switch of said array of switches such that the corresponding respective analog driver output signal is provided to the monitoring device via the feedback line.

9. The apparatus for monitoring the performance of a display driver of a liquid-crystal display of claim 7 wherein the feedback signal provided by the selectably actuatable feedback circuit is proportional to the analog driver output signal produced by said liquid crystal display driver.

10. The apparatus for monitoring the performance of a display driver of a liquid-crystal display of claim 7 wherein the feedback signal provided by the selectably actuatable feedback circuit is substantially equal to the analog driver output signal produced by said liquid crystal display driver.

11. The apparatus for monitoring the performance of a display driver of a liquid-crystal display of claim 7 wherein the feedback signal provided by the selectably actuatable feedback circuit is equal to the analog driver output signal produced by said liquid crystal display driver.

12. The apparatus for monitoring the performance of a display driver of a liquid-crystal display of claim 7 wherein the feedback signal provided by the selectably actuatable feedback circuit is the analog driver output signal produced by said liquid crystal display driver.

13. A method for monitoring the performance of a liquid-crystal display driver for a liquid-crystal display, the method comprising:

(a) providing an analog driver output signal to the liquid-crystal display in response to a data input signal, the analog driver output signal being produced by the liquid-crystal display driver;

(b) selectably actuating a feedback circuit operatively receiving the analog driver output signal such that a feedback signal is provided to a monitoring device via a feedback line; and (c) monitoring the feedback signal provided to the monitoring device via the feedback line to determine the performance of the liquid-crystal display.

14. The method for monitoring the performance of a liquid-crystal display driver for a liquid-crystal display according to claim 13 wherein the feedback signal provided by the selectably actuatable feedback circuit is proportional to the analog driver output signal produced by the liquid crystal display driver.

* * * * *